US006862855B1

(12) United States Patent
Milum et al.

(10) Patent No.: US 6,862,855 B1
(45) Date of Patent: Mar. 8, 2005

(54) STRUCTURAL ASSEMBLY FOR DECKS, WALKWAYS, PATIOS, AND DOCKS

(76) Inventors: Dave G. Milum, 2681 Lower Line West, Milton, Ontario (CA), L9T 2X5; Kevin G. Koshurba, 30 Glen Jane Dr., Campbellville, Ont (CA), L0P 1B0

( * ) Notice: Subject to any disclaimer, the term of this patent is extended or adjusted under 35 U.S.C. 154(b) by 36 days.

(21) Appl. No.: 10/413,610

(22) Filed: Apr. 16, 2003

(51) Int. Cl.[7] ..... E04F 13/14; E04B 5/04

(52) U.S. Cl. ..... 52/384; 52/460; 52/471; 52/764; 52/780; 52/506.07; 52/664

(58) Field of Search ..... 52/384, 460, 461, 52/471, 477, 764, 780, 506.07, 507, 660, 664

(56) References Cited

U.S. PATENT DOCUMENTS

| | | | | | |
|---|---|---|---|---|---|
| 1,884,216 | A | | 10/1932 | Purdy | |
| 1,987,490 | A | * | 1/1935 | Mulford | 404/22 |
| 3,234,692 | A | * | 2/1966 | Bierlich | 52/392 |
| 3,339,329 | A | * | 9/1967 | Berg | 52/395 |
| 3,504,472 | A | * | 4/1970 | Clement | 52/477 |
| 4,067,155 | A | * | 1/1978 | Ruff et al. | 52/105 |
| 4,233,792 | A | * | 11/1980 | Malavasi | 52/387 |
| 4,628,645 | A | * | 12/1986 | Tafelski, Jr. | 52/169.1 |
| 4,682,453 | A | * | 7/1987 | Holmgren | 52/126.2 |
| 4,840,825 | A | | 6/1989 | Aristodimou | |
| 4,999,964 | A | * | 3/1991 | Taylor | 52/477 |
| 5,466,089 | A | | 11/1995 | Jurik | |
| 5,503,498 | A | | 4/1996 | Scheiwiller | |
| 5,611,185 | A | * | 3/1997 | Wilz | 52/506.07 |
| 5,638,653 | A | * | 6/1997 | Rossi | 52/511 |
| D393,727 | S | | 4/1998 | Wiegand, Jr. | |
| 5,806,270 | A | * | 9/1998 | Solano et al. | 52/747.11 |
| 5,902,069 | A | | 5/1999 | Barth et al. | |
| 5,918,437 | A | * | 7/1999 | Dobija | 52/506.01 |
| 6,230,385 | B1 | * | 5/2001 | Nelson | 29/450 |
| 6,427,405 | B1 | * | 8/2002 | Moriya et al. | 52/396.04 |

* cited by examiner

*Primary Examiner*—Brian E. Glessner

(57) ABSTRACT

A structural assembly for decks, walkways, patios, and docks for providing structures for decks, walkways, patios and docks. The structural assembly for decks, walkways, patios, and docks includes a frame assembly including elongate main support members, elongate cross support members, and elongate insert members; and also includes slabs of solid material being supported by the frame assembly.

4 Claims, 3 Drawing Sheets

STRUCTURAL ASSEMBLY FOR DECKS, WALKWAYS, PATIOS, AND DOCKS

BACKGROUND OF THE INVENTION

1. Field of the Invention

The present invention relates to structures for decks, walkways, patios & docks and more particularly pertains to a new structural assembly for decks, walkways, patios, and docks for providing structures for decks, walkways, patios and docks.

2. Description of the Prior Art

The use of structures for decks, walkways, patios & docks is known in the prior art. More specifically, structures for decks, walkways, patios & docks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,902,069; U.S. Pat. No. 1,884,216; U.S. Pat. No. 4,840,825; U.S. Pat. No. 5,466,089; U.S. Pat. No. 5,503,498; and U.S. Pat. No. Des. 393,727.

While these devices fulfill their respective, particular objectives and requirements, the aforementioned patents do not disclose a new structural assembly for decks, walkways, patios, and docks. The prior art includes stones arranged in patterns for various uses and structures.

SUMMARY OF THE INVENTION

The general purpose of the present invention, which will be described subsequently in greater detail, is to provide a new structural assembly for decks, walkways, patios, and docks which has many of the advantages of the structures for decks, walkways, patios & docks mentioned heretofore and many novel features that result in a new structural assembly for decks, walkways, patios, and docks which is not anticipated, rendered obvious, suggested, or even implied by any of the prior art structures for decks, walkways, patios & docks, either alone or in any combination thereof. The present invention includes a frame assembly including elongate main support members, elongate cross support members, and elongate insert members; and also includes slabs of solid material being supported by the frame assembly. None of the prior art includes the combination of the elements of the present invention.

There has thus been outlined, rather broadly, the more important features of the structural assembly for decks, walkways, patios, and docks in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new structural assembly for decks, walkways, patios, and docks which has many of the advantages of the structures for decks, walkways, patios & docks mentioned heretofore and many novel features that result in a new structural assembly for decks, walkways, patios, and docks which is not anticipated, rendered obvious, suggested, or even implied by any of the prior art structures for decks, walkways, patios & docks, either alone or in any combination thereof.

Still another object of the present invention is to provide a new structural assembly for decks, walkways, patios, and docks for providing structures for decks, walkways, patios and docks.

Still yet another object of the present invention is to provide a new structural assembly for decks, walkways, patios, and docks that is primarily made of aluminum and stone to wear and last longer than any of the prior art.

Even still another object of the present invention is to provide a new structural assembly for decks, walkways, patios, and docks that is easy and convenient to assembly and set up.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
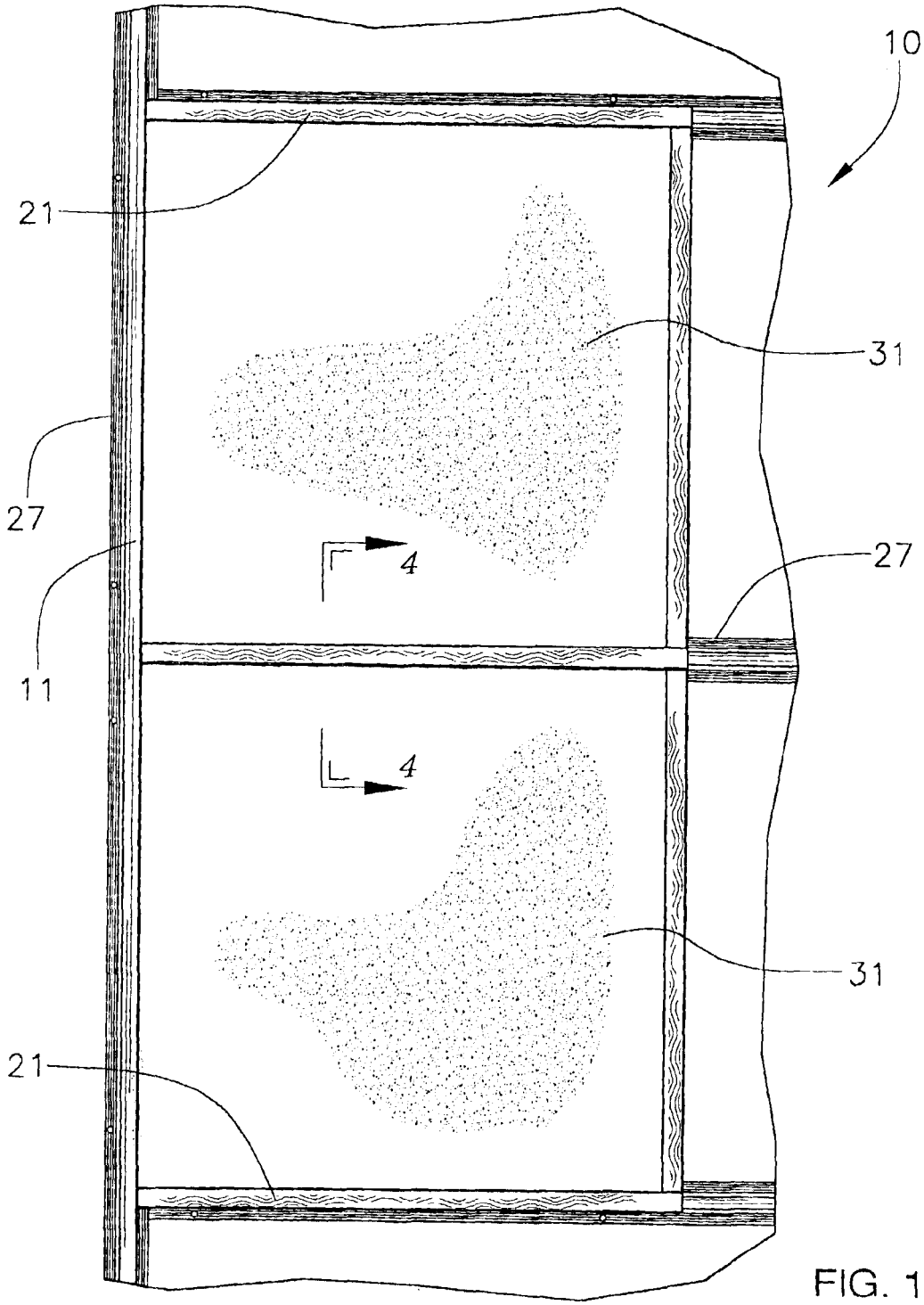
FIG. 1 is a top plan view of a new structural assembly for decks, walkways, patios, and docks according to the present invention.
Figure 2:
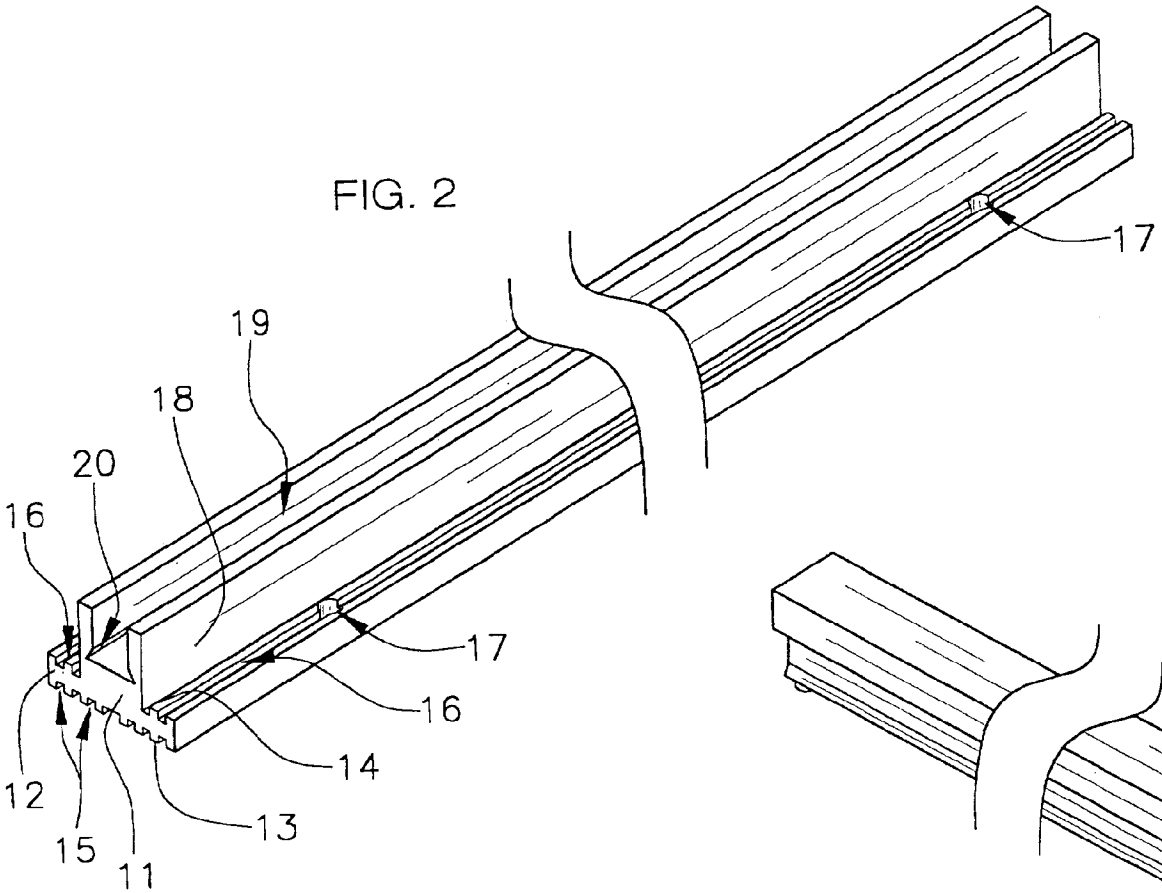
FIG. 2 is a perspective view of an elongate main support member of the present invention.
Figure 3:
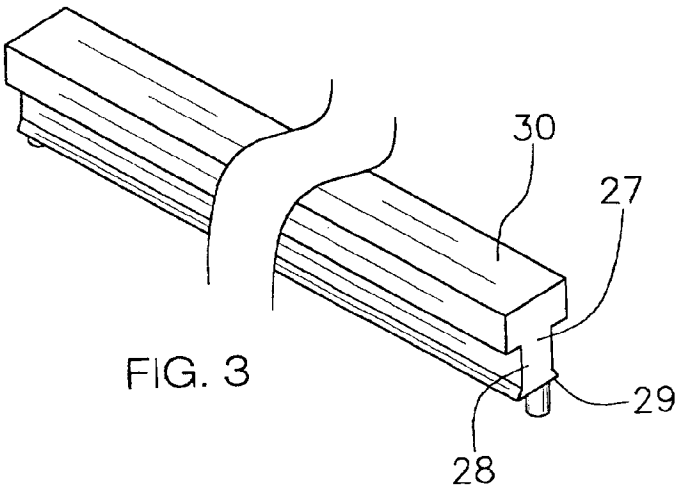
FIG. 3 is a perspective view an insert support member of the present invention.
Figure 4:
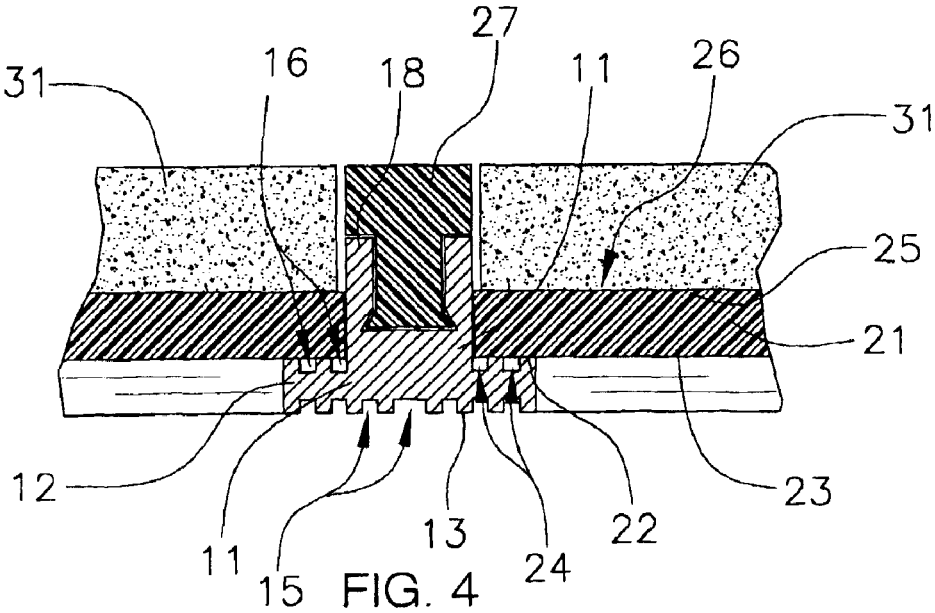
FIG. 4 is a partial cross sectional view of the present invention.
Figure 5:
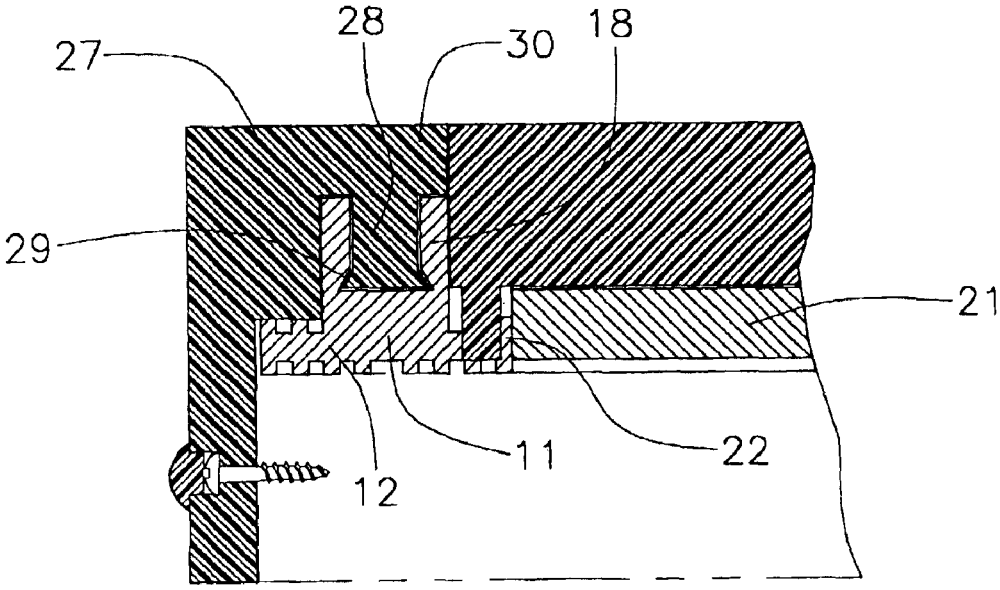
FIG. 5 is another partial cross-sectional view of the present invention.

With reference now to the drawings, and in particular to FIGS. 1 through 5 thereof, a new structural assembly for decks, walkways, patios, and docks embodying the principles and concepts of the present invention and generally designated by the reference numeral 10 will be described.

As best illustrated in FIGS. 1 through 5, the structural assembly for decks, walkways, patios, and docks 10 generally comprises a frame assembly including elongate main support members 11, elongate cross support members 21, and elongate insert members 27. Each of the elongate main support members 11 includes an elongate base portion 12 having a planar bottom side 13 and a top side 14 and also having a plurality of grooves 15 being spacedly disposed in and extending a length of the planar bottom side 13; and also includes a brace portion 18 integrally extending upwardly from the lop side 14 of the elongate base portion 12 and having a channel 19 being disposed in a top side and extending a length thereof and having a laterally-flared bottom portion 20. The elongate base portion 12 has a width greater than that of the brace portion 18. The brace portion 18 has a thickness greater than that of the elongate base portion 12. The base portion 12 also has grooves 16 being disposed in and extending a length of the top side thereof to either side of the brace portion 18. Each of the elongate main support members 11 further has mounting holes 17 being disposed through the base portion 12.

Each of the elongate cross support members 21 includes an elongate base portion 22 having a planar bottom side 23 and a top side and also having lateral-extending slots 24 being disposed in end portions of the planar bottom side 23 and removably interlocking with the grooves 16 in the top side 14 of a respective elongate main support member 11; and also includes a brace portion 25 integrally extending upwardly from the top side of the elongate base portion 22 and having a channel 26 being disposed in a top side and extending a length thereof and having a laterally-flared bottom portion.

Each of the elongate insert members 27 includes a base portion 28 having a laterally-flared bottom portion 29 and being securely and removably disposed in the channel 19, 26 of a respective one of the elongate main support member 11 or the elongate cross support member 21; and also includes a cross portion 30.

Slabs of solid material 31 are securely supported by the frame assembly. The slabs of solid material 31 include slabs of stone being securely and conventionally retained in the frame assembly between the elongate insert members 27.

In use, the user arranges the frame assembly and interlocks the elongate cross support members 21 to the elongate main support members 11, and also securely inserts the elongate insert members 27 in the channels 19, 26 of the elongate main support members 11 and the elongate cross support members 21, and then conventionally attaches the slabs of stone 31 to the frame assembly and in particular to the elongate insert members 27 to securely support the slabs of stone 31.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the structural assembly for decks, walkways, patios, and docks. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A structural assembly for decks, walkways, patios, and docks comprising:

a frame assembly including elongate main support members, elongate cross support members, and elongate insert members, each of said elongate main support members including an elongate base portion having a planar bottom side and a top side and also having a plurality of grooves being spacedly disposed in and extending a length of said planar bottom side; and also including a brace portion integrally extending upwardly from said top side of said elongate base portion and having a channel being disposed in a top side and extending a length thereof and having a laterally-flared bottom portion, said elongate base portion having a width greater than that of said brace portion, said brace portion having a thickness greater than that of said elongate base portion, said base portion also having grooves being disposed in and extending a length of said top side thereof to either side of said brace portion, each of said elongate main support members further having mounting holes being disposed through said base portion; and slabs of solid material being supported by said frame assembly.

2. The structural assembly for decks, walkways, patios, and docks as described in claim 1, wherein each of said elongate cross support members includes an elongate base portion having a planar bottom side and a top side and also having lateral-extending slots being disposed in end portions of said planar bottom side and removably interlocking with said grooves in said top side of a respective said elongate main support member; and also includes a brace portion integrally extending upwardly from said top side of said elongate base portion and having a channel being disposed in a top side and extending a length thereof and having a laterally-flared bottom portion.

3. The structural assembly for decks, walkways, patios, and docks as described in claim 2, wherein each of said elongate insert members includes a base portion having a laterally-flared bottom portion and being securely and removably disposed in said channel of a respective one of said elongate main support member or said elongate cross support member; and also includes a cross portion.

4. The structural assembly for decks, walkways, patios, and docks as described in claim 3, wherein said slabs of solid material includes slabs of stone being securely retained in said frame assembly between said elongate insert members.

* * * * *